US007487883B2

(12) United States Patent
Waters

(10) Patent No.: US 7,487,883 B2
(45) Date of Patent: Feb. 10, 2009

(54) CONTAINER WITH GRIP

(76) Inventor: John Waters, 6116 N. Franklin St., Philadelphia, PA (US) 19120

( * ) Notice: Subject to any disclaimer, the term of this patent is extended or adjusted under 35 U.S.C. 154(b) by 0 days.

(21) Appl. No.: 11/552,092

(22) Filed: Oct. 23, 2006

(65) Prior Publication Data

US 2008/0093333 A1 Apr. 24, 2008

(51) Int. Cl.
*B65D 25/10* (2006.01)
*B65D 53/00* (2006.01)
*B65D 81/24* (2006.01)

(52) U.S. Cl. ..... 220/771; 220/770; 215/398

(58) Field of Classification Search ..... 220/770, 220/771; 215/396, 398
See application file for complete search history.

(56) References Cited

U.S. PATENT DOCUMENTS

| | | | | |
|---|---|---|---|---|
| 3,964,126 | A | 6/1976 | Madsen | |
| 4,045,070 | A | 8/1977 | Geisinger | |
| 4,257,525 | A | 3/1981 | Thompson | |
| D268,480 | S | 4/1983 | Cox | |
| D276,592 | S | 12/1984 | Cox | |
| 4,805,808 | A | 2/1989 | Larson | |
| D303,497 | S | 9/1989 | Larson | |
| 4,892,207 | A * | 1/1990 | Cullis | 215/398 |
| 4,993,565 | A | 2/1991 | Ota | |
| D333,098 | S | 2/1993 | Hestehave | |
| D339,067 | S | 9/1993 | Rokus | |
| 5,366,101 | A | 11/1994 | Krall et al. | |
| D355,367 | S | 2/1995 | Rokus | |
| D361,039 | S | 8/1995 | Rokus | |
| 5,560,506 | A | 10/1996 | Yanagisawa et al. | |
| D397,942 | S | 9/1998 | Lewis | |
| D401,859 | S | 12/1998 | Rokus | |
| D405,004 | S | 2/1999 | Mudra | |
| 5,954,216 | A | 9/1999 | Meisner | |
| D419,885 | S | 2/2000 | Gonzalez | |
| D430,038 | S | 8/2000 | Young | |
| D431,470 | S | 10/2000 | Henderson | |
| D433,636 | S | 11/2000 | Gonzalez | |
| D474,692 | S | 5/2003 | Yu | |
| 6,588,720 | B1 | 7/2003 | Revette | |
| 6,695,163 | B2 | 2/2004 | Michalowski | |
| 6,832,705 | B2 * | 12/2004 | Hollander et al. | 222/465.1 |
| 6,843,634 | B2 | 1/2005 | Goldin | |
| 6,910,596 | B2 | 6/2005 | Herckner | |
| 2003/0173328 | A1 | 9/2003 | Herckner | |

* cited by examiner

*Primary Examiner*—Anthony D Stashick
*Assistant Examiner*—Harry A Grosso
(74) *Attorney, Agent, or Firm*—Muskin & Cusick LLC

(57) ABSTRACT

A bottle for use with an apparatus such as a water cooler that is easy to install. The bottle has a recessed area on the bottom and a handle in the recessed area. The handle allows a human who is to install the bottle on a water cooler an easy way to grip and control the bottle, helping the human avoid spilling the water while the bottle is being installed.

4 Claims, 2 Drawing Sheets

CONTAINER WITH GRIP

BACKGROUND OF THE INVENTION

1. Field of the Invention

The present inventive concept relates to a water bottle for use in a water cooler which can be easily installed and/or removed.

2. Description of the Related Art

Water coolers are standard items in most offices. When the water bottle runs out of water, it needs to be replaced. A full water bottle is quite heavy and difficult to manipulate. After the empty bottle is removed, the full water bottle needs to be turned upside down and placed into the water cooler quickly, otherwise water will spill!

Thus, the replacement of an empty water bottle with a full water bottle in the water cooler is typically a difficult task, as a person with greater than average physical strength and height is more suitable to make the replacement. The person replacing the bottle currently has no easy way to grip the bottle and direct it into the water cooler.

What is needed therefore is a water bottle which can allow for an easier way to install into a water cooler.

SUMMARY OF THE INVENTION

It is an aspect of the present invention to provide a water bottle which is easy to install or remove.

The above aspects can be obtained by an apparatus that includes (a) a container with a bottom; (b) a recessed area in the bottom of the container; and (c) a handle in the recessed area to allow a user to grip the handle.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
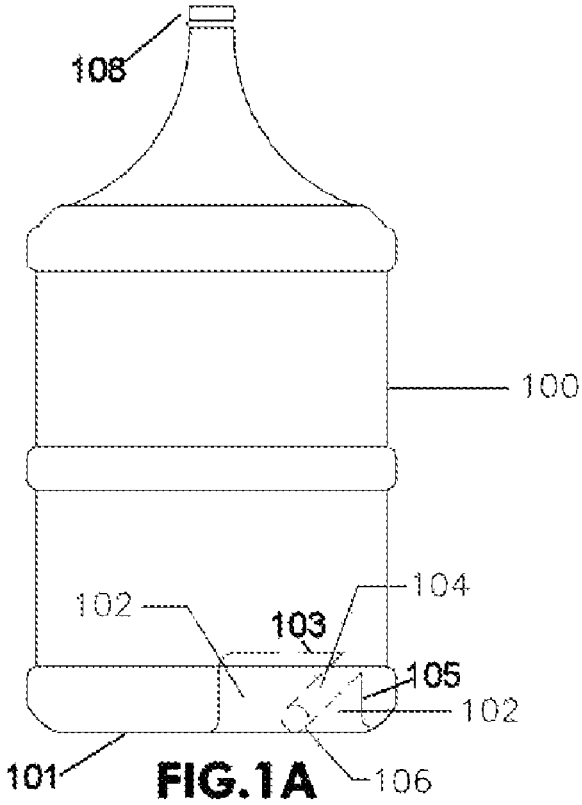
FIG. 1A is side view of a water bottle.

Reference will now be made in detail to the presently preferred embodiments of the invention, examples of which are illustrated in the accompanying drawings, wherein like reference numerals refer to like elements throughout.

The present general inventive concept relates to a water bottle for use in a water cooler. The water bottle can be a standard size water bottle, can have the dimensions of 18" High (15" Body+3" Neck)×10½" Diameter, or any other dimensions for a water bottle. It can be made of molded plastic, or any other material such bottles are made out of.

FIG. 1A is side view of a water bottle.

A container 100 holds water (or other liquid). A bottom of the container 101 can rest on the ground when the container

100 is stored upright (with the nozzle 108) on top. A recessed area 102 is located in the bottom. A handle is located in the recessed area 102 which comprises a grip 106 attached to two shafts 104 which are attached in a corner of the recessed area 102 between a top portion 103 of the recessed area 102 and a side portion 105 of the recessed area 102. The grip 106 is used by a human operator to grab onto in order to lift the bottle easily.

Figure 1B:
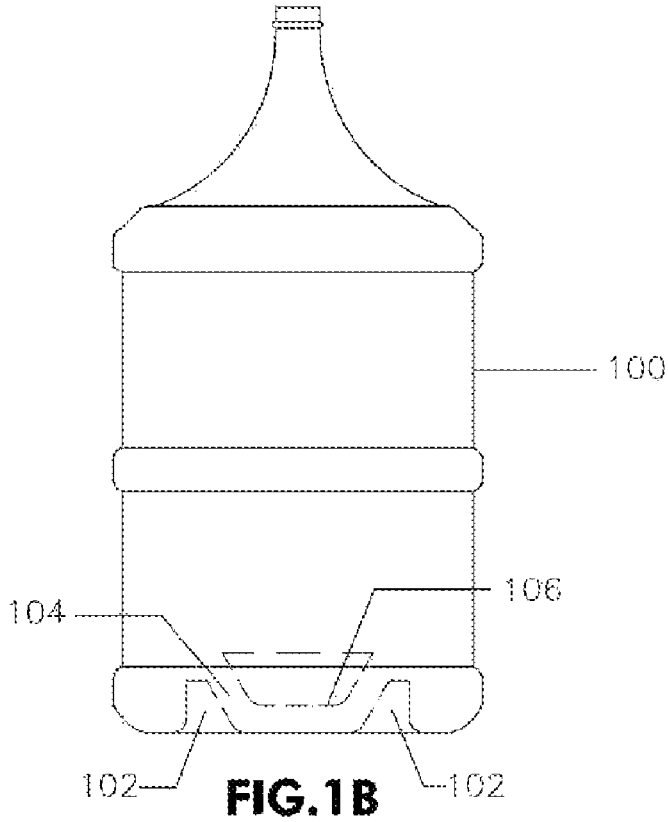
FIG. 1B is side view of a water bottle from a different angle.

FIG. 1B is side view of a water bottle from a different angle.

The container 100 contains a recessed area 102 which contains the grip 106 which is attached to the shafts 104 (which can be separated into a left shaft and a right shaft).

Figure 2A:
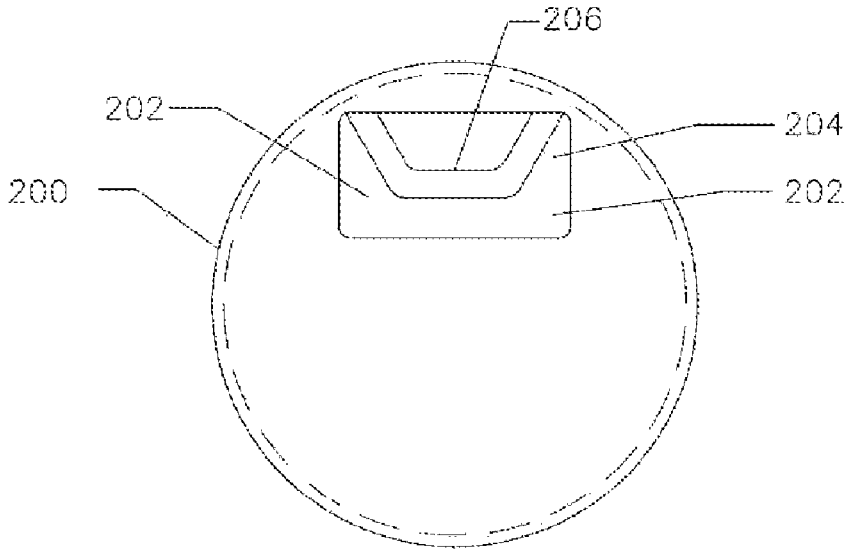
FIG. 2A is a bottom view of a water bottle.

FIG. 2A is a bottom view of a water bottle.

The container 200 comprises a recessed area 202 which contains a grip 206 which is attached to the container 200 using shafts 204.

Figure 2B:
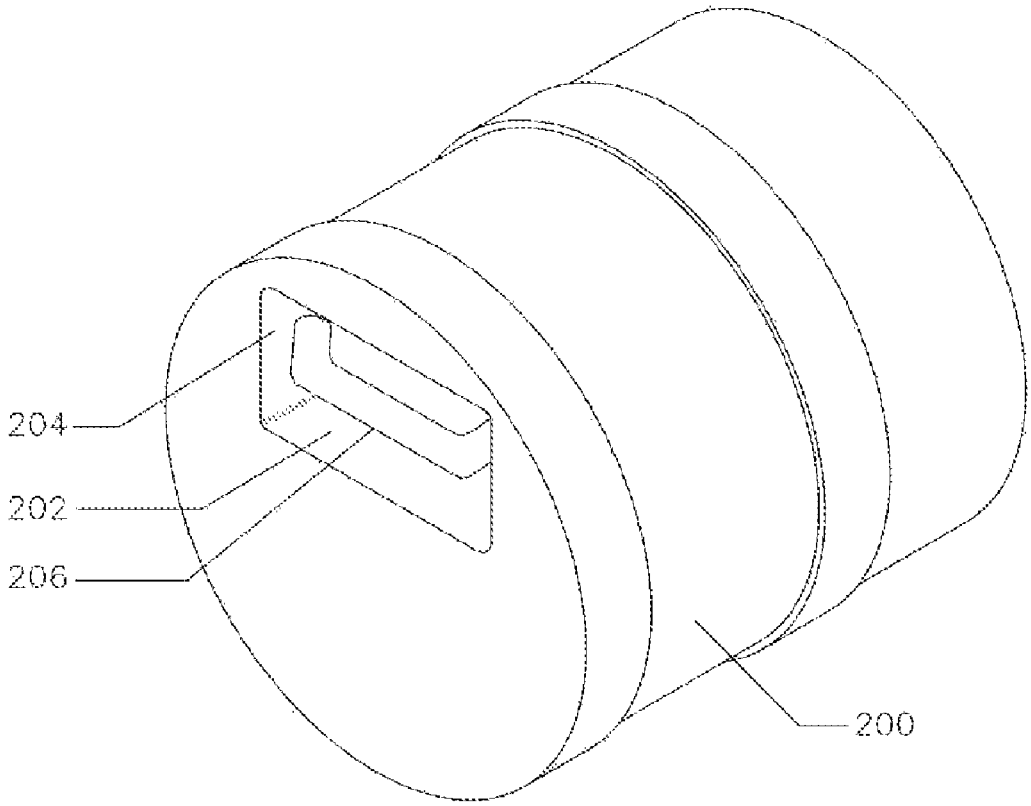
FIG. 2B is an isometric view of a wager bottle.

FIG. 2B is an isometric view of a wager bottle.

The container 200 comprises a recessed area 202 which contains a grip 206 which is attached to the container 200 using shafts 204.

Thus, it can be appreciated by the description and illustrations herein, that the container described herein can be initially placed in an upright stable position with its nozzle on top. An operator can then lift the container by its sides and then place his or her hand around the grip. Once the operator has gripped the grip, the operator can then easily turn the container upside down (with the nozzle pointing downward) yet can easily control the container and direct it into the water cooler.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A water bottle for use in a water cooler, the water bottle comprising:

a container with a bottom and a tubular outside circumference;

a recessed area in the bottom of the container, the recessed area not affecting the tubular outside circumference;

a handle in the recessed area to allow a user to grip the handle, the handle comprising a first shaft which connects a first end of the handle to a first corner on top of the recessed area and a second shaft which connects a second end of the handle to a second corner on top of the recessed area, the first corner of the recessed area and the second corner of the recessed area both being located off-center in the container positioned near the outside circumference, the first shaft and the second shaft diagonally pointing the handle towards the bottom and away from the outside circumference to a position closer to a center of the container.

2. The water bottle as recited in claim 1, wherein the first shaft and second shaft are at an angle between 10 degrees and 80 degrees from a top of the recessed area.

3. The water bottle as recited in claim 1, wherein the handle is at approximately a same level as the bottom of the container.

4. The water bottle as recited in claim 2, wherein the handle is at approximately a same level as the bottom of the container.

* * * * *